US011691698B2

(12) United States Patent
Trotter et al.

(10) Patent No.: US 11,691,698 B2
(45) Date of Patent: Jul. 4, 2023

(54) SAFETY LIGHTING SYSTEM FOR WATERCRAFT

(71) Applicants: Daniel Scott Trotter, Gilbert, SC (US); Maron Isom, Chapin, SC (US)

(72) Inventors: Daniel Scott Trotter, Gilbert, SC (US); Maron Isom, Chapin, SC (US)

( * ) Notice: Subject to any disclaimer, the term of this patent is extended or adjusted under 35 U.S.C. 154(b) by 0 days.

(21) Appl. No.: 17/524,787

(22) Filed: Nov. 12, 2021

(65) Prior Publication Data

US 2023/0150620 A1 May 18, 2023

(51) Int. Cl.

| | |
|---|---|
| ***B63B 45/04*** | (2006.01) |
| ***H05B 47/11*** | (2020.01) |
| ***H05B 47/155*** | (2020.01) |
| ***B63B 49/00*** | (2006.01) |
| ***G08B 21/14*** | (2006.01) |
| *G08G 3/02* | (2006.01) |
| *B63B 45/00* | (2006.01) |

(52) U.S. Cl.

CPC ..... *B63B 45/04* (2013.01); *B63B 49/00* (2013.01); *G08B 21/14* (2013.01); *H05B 47/11* (2020.01); *H05B 47/155* (2020.01); *B63B 2045/005* (2013.01); *B63B 2201/08* (2013.01); *B63B 2213/02* (2013.01); *G08G 3/02* (2013.01)

(58) Field of Classification Search

CPC ..... B63B 45/04; B63B 45/06; B63B 49/00; B63B 2213/02; H05B 47/11; H05B 47/155; G08B 21/14; G08G 3/02

See application file for complete search history.

(56) References Cited

U.S. PATENT DOCUMENTS

| | | | | |
|---|---|---|---|---|
| 5,614,788 | A | 3/1997 | Mullins et al. | |
| 6,014,207 | A | 1/2000 | Suzuki et al. | |
| 6,273,771 | B1 * | 8/2001 | Buckley | B63H 21/213 114/144 RE |
| 7,653,215 | B2 | 1/2010 | Stam | |
| 7,759,819 | B2 | 7/2010 | Michiyama et al. | |
| 8,757,851 | B1 | 6/2014 | Clemons | |

(Continued)

FOREIGN PATENT DOCUMENTS

WO WO2016099419 6/2016

*Primary Examiner* — Alexander H Taningco
*Assistant Examiner* — Pedro C Fernandez
(74) *Attorney, Agent, or Firm* — Southeast IP Group, LLC.; Thomas L. Moses

(57) ABSTRACT

A watercraft safety lighting system includes one or more light sensors for measuring ambient light levels, which are operatively connected to an electronic controller, such as a programmable logic controller or any suitable programmable computing device. The navigation lights are operatively connected to the electronic controller, as well as docking lights, interior lights, and instrument panel lighting, such as the lighting for gauges, instrument panels, video screens, GPS monitors, and the like. When ambient light levels reach a predetermined level of low light (as darkness is setting in, for example), the electronic controller is programmed to switch on the navigation lights, and to adjust other lighting to appropriate levels for night-time operations. The system may also shut off docking lights at a predetermined speed after dark, and may include alarms to warn the boat captain of improper lighting settings in low-light conditions.

11 Claims, 4 Drawing Sheets

(56) References Cited

U.S. PATENT DOCUMENTS

| | | | | |
|---|---|---|---|---|
| 8,803,711 | B1 * | 8/2014 | Gonring | H05B 47/155 340/987 |
| 9,227,556 | B2 | 1/2016 | Longueville et al. | |
| 9,751,456 | B1 | 9/2017 | Miller | |
| 10,029,608 | B2 | 7/2018 | Miller | |
| 10,457,358 | B1 | 10/2019 | Granata | |
| 10,793,245 | B1 * | 10/2020 | Trotter | G08B 7/06 |
| 2006/0040570 | A1 * | 2/2006 | Tsumiyama | B63B 34/10 440/2 |
| 2008/0246404 | A1 | 10/2008 | Shelton et al. | |
| 2013/0234593 | A1 * | 9/2013 | Nordstrom | B60Q 3/80 315/80 |
| 2020/0249213 | A1 * | 8/2020 | Gregg | G07C 5/008 |
| 2021/0078689 | A1 * | 3/2021 | Zhou | B60L 15/20 |
| 2021/0147044 | A1 * | 5/2021 | Beers | H05B 45/20 |

* cited by examiner

SAFETY LIGHTING SYSTEM FOR WATERCRAFT

FIELD OF THE INVENTION

The present invention relates to safety lighting systems, primarily used on watercraft. More specifically, the present invention includes a system for ensuring that watercraft are properly displaying navigation lights and other types of lights under various lighting conditions, particularly while the vessel is underway.

BACKGROUND OF THE INVENTION

As boating has become tremendously popular in recent years, the number of boats on lakes, rivers and other bodies of water has exploded. With the high number of watercraft that are operating on these waterways, there has been a sharp increase in the number of boating accidents, and an alarming number of these accidents occur at night. Oftentimes, these accidents are at least partially due to failure of boat captains to ensure that the navigation lights (as well as other lights, such as interior lights and docking lights) are properly displayed while operating in darkness or low-light conditions.

For example, it is not unusual for a boat captain to forget to turn on the navigation lights after dark. Also, many boats include docking lights that are only supposed to be used at idle speed while the vessel is maneuvering at idle speed during docking procedures. Further, many modern watercraft also include interior lighting for illuminating the interior of the boat, including interior lights positioned around the interior of the vessel, as well as light emitted by instruments and gauges, such as GPS screens, and the like.

Failing to switch the navigation lights on while the boat is underway in darkness is a common problem, and can prevent other boats from observing the unlit vessel. Additionally, in most (if not all) states, boating laws require that docking lights be used only at idle speed, but boat captains frequently operate their boats at plane speed while the docking lights are fully illuminated, which can confuse other boat captains with respect to the direction the boat is traveling. Docking lights can also temporarily blind oncoming boaters. Moreover, failure to dim the interior lights of the vessel, including the light emanating from GPS screens, gauges, and other interior lighting during nighttime operations can cause a boat captain to experience impaired night vision due to these interior lights.

Thus, it would be desirable to provide a watercraft lighting safety system that automatically adjusts the various lights on a boat, by integrating light sensors into a smart system that controls the navigation lights, docking lights, and interior lights based on the ambient light levels.

Many types of "smart" lighting systems have been developed for various types of vehicles, although most of these systems have been more specifically developed for land-based vehicles such as cars, trucks, motorcycles, and the like. While some of the concepts of these systems are similar in nature to the present system, watercraft lighting systems face different challenges, and operate in a different manner, than most of the vehicle lighting systems described below.

Examples of vehicle lighting systems are described below, and the following references are hereby incorporated by reference herein, in their entireties:

U.S. Pat. No. 5,614,788 Automated Ambient Condition Responsive Daytime Running Light System An automated daytime running light system for surface transport vehicles having headlights and taillights which includes a daytime running light control circuit which activates the highbeam filament of the headlights at a reduced power level whenever the vehicle ignition is ON and the starter motor OFF during daylight conditions. In one embodiment, the daytime running light control circuit activates the high beam filaments of the headlight at a reduced power level and also activates the parking lights to provide taillights whenever the vehicle ignition is ON and the starter motor OFF during daylight conditions. The system further includes a navigational lighting control circuit which is responsive to ambient condition sensor inputs such as low light level sensors, fog or moisture sensors, windshield wiper actuation sensors and the like, to de-activate the daytime running light control circuit and activate the vehicles headlights and taillights and other running lights at normal power levels as long as such sensors are activated or whenever the vehicle headlights are manually activated. The system may further include an emergency brake indicator circuit which turns off the daytime running light and navigational lighting control circuits, and the vehicle headlights and/or taillights controlled thereby, whenever the emergency brake is engaged and may further include an external shut-off circuit for turning off the daytime running light and navigational lighting control circuits, or portions thereof, when activated.

U.S. Pat. No 6,014,207 Vehicle Lighting Unit

When a vehicle enters into the lower portion of a shielding member, a headlamp is switched on, and a condition flag is set to Set 1 which represents a waiting state in which the vehicle exterior is estimated to become bright/dark intermittently. When the condition flag is set to Set 1, when the vehicle enters into the lower portion of the shielding member, the condition flag is set from Set 1 to Set 2 which represents an intermittent state in which the vehicle exterior becomes bright/dark intermittently with high possibilities. When the condition flag is set to Set 2, a switch-off extension time CFE and a switch-off delay time CTF make a time until the headlamp is switched off. As a result, the time until the headlamp is switched off is delayed, and the headlamp is required to remain switched on at portions where the vehicle exterior becomes bright/dark intermittently.

U.S. Pat. No. 7,653,215 System for Controlling Exterior Vehicle Lights

A system and method of automatically controlling exterior vehicle lights includes an image sensor and a controller to generate control signals. The control signals are derived based on information obtained from the image sensor as well as other detected parameters pertaining to the detected light source(s), the vehicle having the inventive control system, and the ambient environment. The control circuit may simply turn certain exterior lights on or off, or change the brightness, aim, focus, etc. to produce various beam patterns that maximize the illuminated area in front of the vehicle without causing excessive glare in the eyes of other drivers.

U.S. Pat. No. 7,759,819 Illumination Control Device for Vehicle

An illumination control unit includes an automatic control function for automatically controlling the turning on and off of vehicle head lights depending on brightness of an environment around a vehicle. A sensitivity adjuster is installed on a lever extending from a steering column in a vehicle compartment. The sensitivity to the brightness of the environment around the vehicle at the time when the auto-on and auto-off state of the vehicle lights is changed can be adjusted with the sensitivity adjuster.

U.S. Pat. No. 8,757,851 Location and Weather Information Activated Illumination Device for Outboard Marine Motors An illumination device includes a telescoping mast with a stern navigation light source, a first rear facing illumination source, a second rear facing illumination source, a front-facing inboard light source stationed between the first and second light sources, a weather receiver which receives location-based weather information, and a geo-location receiver in communication with the weather receiver. The mast automatically telescopes and retracts, and the stern navigation light source automatically turns on and off, based at least in part on the information. The illumination device can be provided in an outboard marine motor, or as a system for retrofitting existing outboard marine motors.

U.S. Pat. No. 9,227,556 Lighting Control System and Method for a Motor Vehicle

A lighting control system and a lighting control method to implement in an automotive vehicle, external running lights in different available lighting configurations are provided. The lighting control method includes detecting at least one environment parameter, selecting among the different available lighting configurations and depending on the parameter, which lighting configurations can be implemented, depending on the parameter, defining in which order the selected lighting configurations are implemented when an input device is manually actuated, detecting a manual actuation on the input device, depending on a motion of the input device or a motion on the input device, implementing at least one lighting configuration that is chosen among the selected lighting configurations according to the implementation order.

U.S. Pat. No. 9,751,456 Headlight Setting Activation via a Stalk Switch

Method, apparatus, and computer storage media are disclosed for headlight setting activation via a stalk switch. An example vehicle includes a stalk switch and a headlamp controller. The example headlamp controller is to monitor the stalk switch and detect, in response to identifying the stalk switch is transitioning to a high-beam position, a number of occurrences the stalk switch is set at the high-beam position in a predetermined time period. Also, the example headlamp controller is to activate, in response to determining the number of occurrences is two, a first headlight setting of headlamps.

U.S. Pat. No. 10,029,608 Automated Vehicle Lighting Control

A vehicle includes headlights, a headlight switch, and a controller. The headlight switch may have automatic and override positions, and include a biasing member configured to return the switch to the automatic position from the override position. The controller may be configured to, in response to a signal indicative of movement from the automatic position to the override position, illuminate the headlights until the vehicle is in a key-off state, and prior to the signal, illuminate the headlights based on ambient light conditions. Also, the controller may set a threshold based on a level of ambient light sensed at a time of the input indicative of headlight switch movement from the automatic position to the override position and illuminate the headlights until first occurrence of the ambient light exceeding the threshold or the vehicle being in the key-off state.

U.S. Pat. No. 10,457,358 Marine Safety Lighting

When a marine engine is on, automatic daytime running lights shall be illuminated. For example, white lights situated in the bow area of the boat would increase visibility of a boat to others, for safety purposes. The same lights or lights generally in the same area, at dusk and/or at night shall manually or automatically transition to red/green navigation lights.

U.S. Application No. 20080246404 Vehicle Headlight Beam Controls

A method of manually overriding automatic activation of an automatic headlight control system for a motor vehicle, headlamps operable in a high beam state and a low beam state, a high/low beam switch movable from a neutral position to a latched position and from a neutral position to a non-latched position for controlling the state of the headlamps and a headlamp on/off switch comprising a multi-position switch with at least a selectively automatic headlamp position is disclosed. The system includes forward-facing sensor for collecting light emanating from for instance a second vehicle, and a controller for controlling, when the headlamp switch is detected as being in the automatic headlamp position, the headlamp states as a function of the sensed intensity of the beam of light emanating from said second vehicle. The method comprises the steps of: monitoring the states of the headlamps when the headlamp on/off switch is in the automatic position, causing the controller to initiate an override mode if the high beam states is detected (step 230) and said high/low beam switch is detected as moved from the neutral position to the non-latched position whereupon the controller changes the headlamps to the Low state (step 260) when the High/Low beam switch is subsequently released to the neutral position. Such a method ensures the use of conventional stalk.

U.S. Application No. 20130234593 Systems and Methods for Controlling Vehicle Lighting A system for controlling a lighting system for a vehicle includes an ambient light sensor operable for detecting a level of ambient light and a lighting circuitry. The system also includes a logical control unit that receives input signals from a vehicle control unit, a user input device and the ambient light sensor. The logical control unit controls a voltage on the lighting circuitry to provide a minimum voltage based on the one or more input signals.

WO2016099419 An Automatic Illumination System

The invention subject to the application is related to a system where the vehicle interior illumination lighting level can be adjusted automatically by means of a programmable electronic control unit (2) using the information obtained from a sensor (5), by the vehicle interior illumination hardware which is illuminated by LEDs (4).

BRIEF SUMMARY OF THE INVENTION

In accordance with one aspect of the invention, a first embodiment of a watercraft safety lighting system includes one or more light sensors for measuring ambient light levels. These light sensors are operatively connected to a programmable electronic controller, such as a programmable logic controller or any suitable programmable computing device. In one embodiment, the navigation lights (at least one red light on the port side of the vessel and at least one green light positioned on the starboard side of the vessel) are operatively connected to the electronic controller, as well as docking lights, interior lights, and instrument panel lighting, such as the lighting for gauges, instrument panels, video screens, GPS monitors, and the like.

In one embodiment, the light sensors are deployed to detect ambient light levels, and provide a continuous data feed to the electronic controller regarding current ambient light levels. When ambient light levels reach a predetermined level of low light (as darkness is setting in, for example), the electronic controller is programmed to switch on the navigation lights, and to adjust other lighting to appropriate levels for night-time operations. For example, during hours of darkness, the electronic controller may switch the instrument screens such as GPS, fuel level gauges, speedometer, RPM gauges, battery power gauges, video screens and other instruments, as well as other interior lighting, to appropriate brightness levels in order to provide optimal visibility to the boat captain.

The electronic controller may also be operatively connected to the GPS system, the RPM gauges, and/or the speedometer, as well, in order to properly operate the docking lights or other components. In this embodiment, the electronic controller may automatically shut off the docking lights when the vessel reaches a speed above a predetermined limit (preferably at a low or idle speed, but certainly below displacement speed where the boat is 'up on plane,' and traveling fast).

The present system may also include alarms to warn the boat captain that the navigation lights are not switched on during hours of darkness, or when ambient light levels are below a predetermined level. The alarm(s) may take any form, such as an audio alarm, a visual alarm such as a flashing light on the helm, or a warning displayed on a video screen. The alarm(s) may be operatively connected to, and controlled by, the electronic controller. The alarms may also be used to alert the boat captain that the navigation lights (or any other lights controlled by the system) are not functioning properly (ie. when a light bulb has burned out, or a fuse has blown).

It is also contemplated that the system may be operatively connected, either wirelessly or via a cord or docking station, by a hand-held mobile device, such as a smart phone or iPad. These mobile devices may include software, commonly referred to as an 'app,' that may be used to operate the lighting system remotely, and to receive alerts or notifications from the vessel's lighting system.

BRIEF DESCRIPTION OF THE DRAWINGS

These and other features, aspects, and advantages of the present invention will become better understood with regard to the following description, appended claims, and accompanying drawings where:

DETAILED DESCRIPTION OF THE INVENTION

Figure 1:
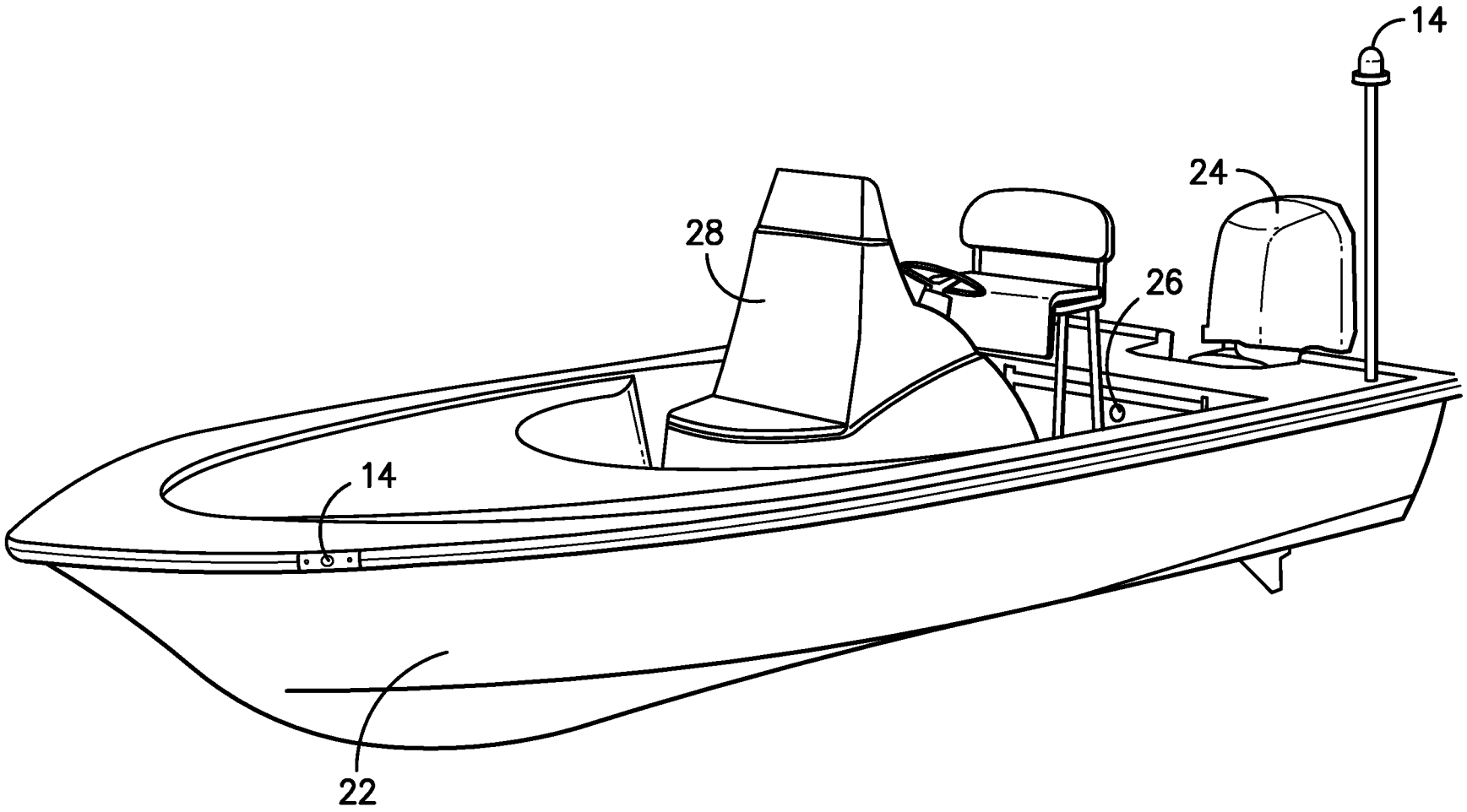
FIG. 1 is a perspective view of a boat that includes one embodiment of the safety lighting system, including navigation lights, a light sensor, and a carbon monoxide detector, all of which are operatively connected to a programmable electronic controller.
Figure 2:
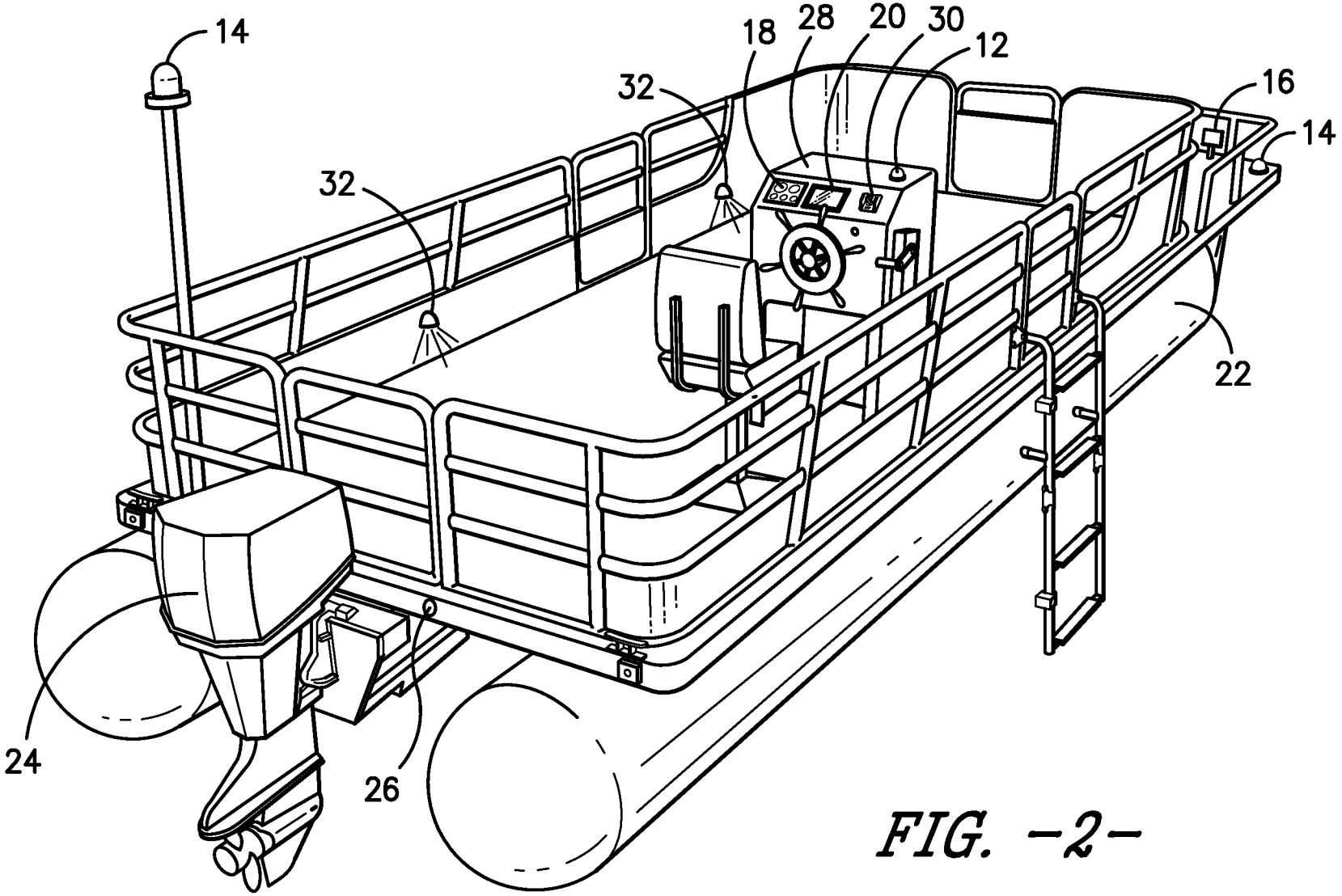
FIG. 2 is a perspective view of a boat that includes one embodiment of the safety lighting system, including navigation lights, a light sensor, and a carbon monoxide detector, all of which are operatively connected to a programmable electronic controller.
Figure 3:
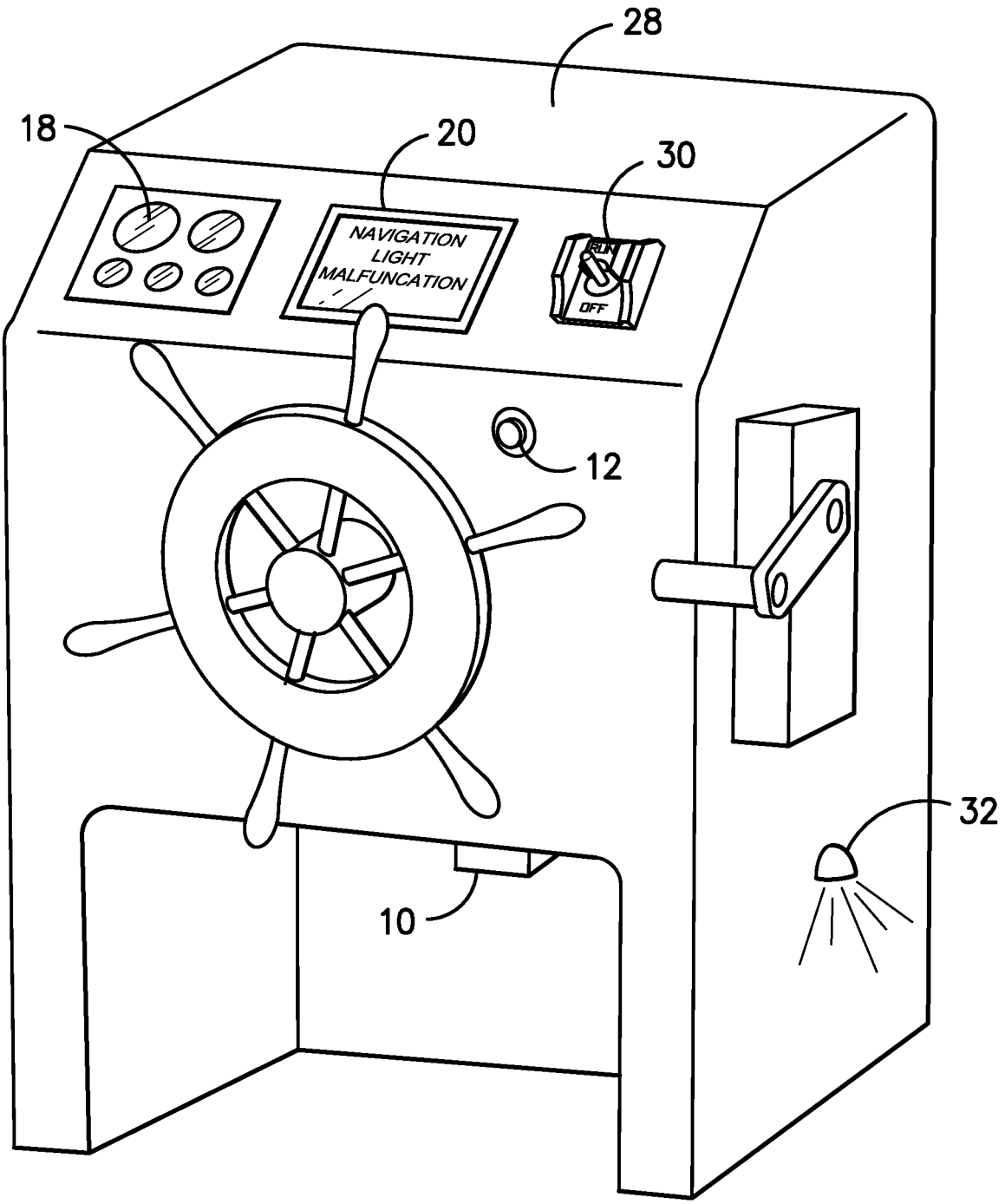
FIG. 3 is a perspective view of a helm of a boat that includes one embodiment of the safety lighting system, wherein the helm includes a light sensor, a video screen, a kill switch, and gauges that include lighting therein for nighttime operations, all of which are operatively connected to a programmable electronic controller.
Figure 4:
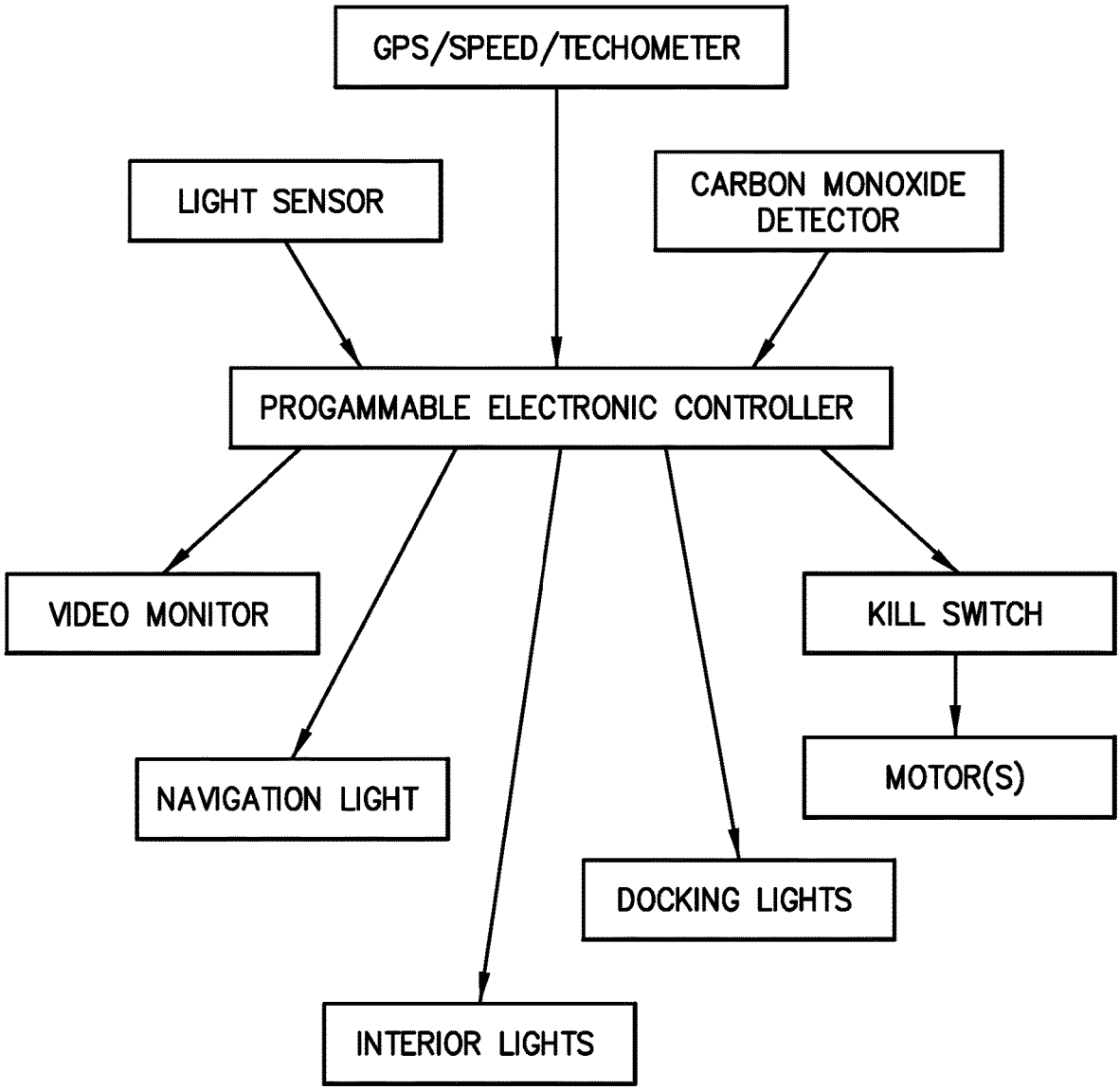
FIG. 4 is a schematic view of one embodiment of a safety lighting system for a boat or watercraft.

The present invention includes, in a first embodiment, a safety lighting system for watercraft includes a programmable electronic controller 10 that is operatively connected to various lights on a vessel, as well as one or more light sensors 12 for determining ambient light levels. In one embodiment, the navigation lights 14 (at least one red light on the port side of the vessel and at least one green light positioned on the starboard side of the vessel, as well as the stern anchor light) are operatively connected to the electronic controller 10, as well as docking lights 16, interior lights, and instrument panel lighting, such as the lighting for gauges 18, instrument panels, video screens 20, GPS monitors, and the like, as shown in FIGS. 1-3. A schematic drawing of the system is shown in FIG. 4.

The electronic controller 10 is programmed to operate the various lights based on data input from the light sensor(s) 12, and specific lights may be operated in a different manner from the other lights, based on the functionality of each specific light or series of lights. For example, when the light sensors 12 detect ambient light levels below a predetermined level, it may switch on the navigation lights 14 (including the red light on the port side, the green light on the starboard side, and the stern light). The navigation lights 14 are typically either in the off position or the on position, and it is generally not necessary (or recommended) to adjust brightness levels of the navigation lights 14, as they should always be illuminated as brightly as possible for safety purposes.

Control of the navigation lights 14 may take several different forms. For instance, in one embodiment, the system may be programmed to automatically switch the navigation lights 14 on when darkness falls. In another embodiment, the system may be programmed to simply activate an alarm to alert the boat captain that the navigation lights are not on when the light sensors detect low ambient light levels, and the captain may switch the navigation lights 14 to the on position, thereby causing the alarm to deactivate. The alarm(s) may take any suitable or desired form, such as an audio alarm, a visual alarm such as a flashing light on the helm, a warning displayed on a video screen 20, a notification sent to a handheld wireless device, or any combination thereof. The alarm(s) may be operatively connected to, and controlled by, the electronic controller 10. The alarms may also be used to alert the boat captain that the navigation lights 14 (or any other lights controlled by the system) are not function properly (ie. when a light bulb has burned out, or a fuse has blown). Additionally, the alarm(s) may be used to indicate that the docking lights 16 are on, where the alarm is triggered by 1) the docking lights 16 are switched on, and 2) the boat has reached a predetermined speed above idle speed.

For helm lighting, which includes all instrument gauges 18, video displays 20, backlights, GPS screens, touchscreens and the like, any or all of those components may be operatively connected to the electronic controller 10, so that the system may adjust those lights to appropriate levels, based on the ambient light data provided by the light sensors 12. In one embodiment, these lights may be programmed to dim on a sliding scale, so that they may appear bright in broad daylight, may dim slightly at dusk when ambient light levels are lower (but not completely dark yet), and may adjust further as ambient light levels drop to nighttime levels. It is contemplated that these adjustments may be programmed by a user, as some captains may need the helm lights to be a bit brighter than other captains at various ambient light levels.

Similarly, other interior lighting around the interior or exterior of the boat 22 (preferably excluding navigation lights) may be automatically dimmed, brightened, or adjusted by the system, based on the ambient light level data provided by the light sensors. These interior lights may include lights around the cabin, adjacent to passenger seating, around cupholders, along aisles, adjacent doors, lights positioned on or within audio speakers, and the like.

In one embodiment, the interior lights and/or the helm instrument lights may be programmed to adjust brightness levels based not only on ambient light levels, but also based on whether the boat 22 is underway, or is stopped or drifting but not under power. For example, the interior lighting and or helm lighting might be programmed to brighten to a predetermined level at night when the boat 22 is at rest or drifting with the motor 24 disengaged, and may be further programmed to dim when the boat 22 reaches a predetermined speed (based on data from the GPS system, the speedometer, the RPM gauges, or some combination of these components). It is contemplated that the system may be pre-programmed by the factory or manufacturer to certain default settings, and may further be programmable by the user to adjust to a user's preferred functionality (including brightness levels under certain conditions, and whether certain lights are in the on or off position under various conditions). For example, some boat captains prefer to completely turn off interior lighting while running at night, operating only the navigation lights and the helm instrument lights. Other boat captains may desire to have the interior lighting become bright when the boat 22 is at rest, and then to dim when the boat 22 is underway or reaches a predetermined speed.

In an embodiment where some aspects of the safety lighting system are user programmable, a control panel, touch screen, or the like may be operatively connected to the electronic controller to provide a user interface for programming the system according to the user's preferences. Alternatively, the boat lighting system interface may be displayed on a video monitor or touch screen that is already installed on the vessel for other purposes, such as commonly used Simrad® screens that are routinely used in modern vessels for displaying various types of data, such as GPS map screens, instrument gauges, speedometers, RPMs, and the like.

It is also contemplated that the safety lighting system may be operatively connected, either wirelessly or via a cord or docking station, by a hand-held mobile device, such as a smart phone or iPad. These mobile devices may include software, commonly referred to as an 'app,' that may be used to operate the lighting system remotely, and to receive alerts or notifications from the vessel's lighting system. Essentially, the system may be operated and programmed remotely by the handheld device, preferably via a wireless connection, such as BlueTooth, WiFi, or any other suitable wireless communications method.

In another embodiment, the electronic controller may also be operatively connected to the ignition key or button on a watercraft 22, and may be programmed to prevent the motor 24 from starting if the light sensor detects low ambient light levels while the navigation lights 14 are switched to the off position. In other words, if the navigation lights 14 are not switched on after dark, the motor 24 will not start. Alternatively, the system may be programmed so that the motor 24 will start, but the propellor will not engage until the navigation lights 14 are switched on. In these embodiments, it is contemplated that an alarm (as described above) may be activated to notify the boat captain that the navigation lights 14 are not switched on, so that the captain understands that the watercraft 22 is operating properly, and that the problem is that the navigation lights 14 are off. Once the navigation lights 14 are switched to the on position during low-light conditions, the motor 24 starts and the boat 22 may shift into gear for normal nighttime operations.

Optionally, the system may include a carbon monoxide detector 26 that is preferably positioned in the stern section of the boat 22 or any place where exhaust fumes may be emitted. In use the carbon monoxide detector 26 monitors the air for carbon monoxide, and triggers an alarm when the carbon monoxide levels reach a predetermined concentration. The carbon monoxide detector 26 may be connected to a speaker or through the stereo system to emit an audio alarm, and/or may be operatively connected to the programmable electronic controller 10, which can be programmed to make the interior lights, or any other lights, flash or pulse, in order to provide a visual warning or distress signal. Additionally, the programmable electronic controller 10 may also be programmed to display warning language or some other visual alarm on a video screen or monitor 20 at the helm 28, when the carbon monoxide alarm is triggered. Alternatively, the carbon monoxide detector 26 may be operatively connected to a kill switch 30 on the boat 22, so that when excessive levels of carbon monoxide are detected, the kill switch 30 shuts down the motor(s) 24 of the boat 22 in order to prevent additional noxious gases from being generated by the motor(s) 24.

Although the present invention has been described in considerable detail with reference to certain preferred versions thereof, other versions are possible. Therefore, the spirit and scope of the appended claims should not be limited to the description of the preferred versions contained herein. All features disclosed in this specification may be replaced by alternative features serving the same, equivalent or similar purpose, unless expressly stated otherwise. Thus, unless expressly stated otherwise, each feature disclosed is one example only of a generic series of equivalent or similar features.

The invention claimed is:

1. A safety lighting system for a watercraft comprising:

at least one light sensor for detecting brightness levels of ambient light;

a programmable electronic controller operatively connected to said light sensor;

navigation lights operatively connected to said programmable electronic controller;

docking lights operatively connected to said programmable electronic controller;

a global positioning satellite receiver for determining the location and speed of said receiver, said global positioning satellite receiver being operatively connected to said programmable electronic controller;

wherein said programmable electronic controller is programmed to receive ambient light level data from said light sensor, and to turn on said navigation lights when said ambient light levels are detected below a predetermined level; and wherein said programmable electronic controller is programmed to switch off said docking lights when said global positioning satellite receiver detects that said global positioning satellite receiver is moving at a speed above a predetermined level.

2. The safety lighting system for a watercraft set forth in claim 1, further including gauge lights that are operatively connected to said programmable electronic controller, wherein said programmable electronic controller is programmed to adjust said gauge lights when said light sensor detects ambient light below a predetermined level.

3. The safety lighting system for a watercraft set forth in claim 1, further including a kill switch for shutting off a boat motor, wherein said kill switch is operatively connected to said programmable electronic controller.

4. The safety lighting system for a watercraft set forth in claim 3, further including a carbon monoxide detector that is operatively connected to said programmable electronic controller;

wherein said programmable electronic controller is programmed to turn off said kill switch Then said carbon monoxide detector detects carbon monoxide levels that are above a predetermined level.

5. The safety lighting system for a watercraft set forth in claim 1, further including a video screen that is operatively connected to said programmable electronic controller; and wherein said programmable electronic controller is programmed to adjust brightness levels of said video screen based on levels of ambient light detected by said light sensor.

6. The safety lighting system for a watercraft set forth in claim 1, further including a plurality of interior lights adapted to be positioned on an interior portion of a boat;

wherein said interior lights are operatively connected to said programmable electronic controller; and wherein said programmable electronic controller is programmed to adjust brightness levels of said interior lights based on ambient light levels detected by said light sensor.

7. The safety lighting system for a watercraft set forth in claim 6, further including a carbon monoxide detector operatively connected to said programmable electronic controller;

wherein said programmable electronic controller is programmed to intermittently flash said navigation lights and said interior lights when said carbon monoxide detector detects carbon monoxide levels above a predetermined level.

8. A safety lighting system for a watercraft comprising:

at least one light sensor for detecting brightness levels of ambient light;

a programmable electronic controller operatively connected to said light sensor; and docking lights operatively connected to said programmable electronic controller;

wherein said programmable electronic controller is programmed to receive ambient light level data from said light sensor, and to turn off said docking lights when said ambient light levels are detected above a predetermined level; and a global positioning satellite receiver for determining the location and speed of said receiver, said global positioning satellite receiver being operatively connected to said programmable electronic controller;

wherein said programmable electronic controller is programmed to switch off said docking lights when said global positioning satellite receiver detects that said global positioning satellite receiver is moving at a speed above a predetermined level.

9. The safety lighting system for a watercraft set forth in claim 8, further comprising:

navigation lights operatively connected to said programmable electronic controller;

wherein said programmable electronic controller is programmed to turn on said navigation lights when said ambient light levels are detected below a predetermined level.

10. A safety lighting system for a watercraft comprising:

at least one light sensor for detecting brightness levels of ambient light;

a programmable electronic controller operatively connected to said light sensor;

navigation lights operatively connected to said programmable electronic controller; and a kill switch that is adapted to be operatively connected to a motor, said kill switch being operatively connected to said programmable electronic controller wherein said programmable electronic controller is programmed to receive ambient light level data from said light sensor, and to switch said kill switch to an off position when said programmable electronic controller detects that the navigation lights are switched off when said light sensor indicates that ambient light levels are detected below a predetermined brightness level; and a global positioning satellite receiver for determining the location and speed of said receiver, said global positioning satellite receiver being operatively connected to said programmable electronic controller;

wherein said programmable electronic controller is programmed to switch off said docking lights when said global positioning satellite receiver detects that said global positioning satellite receiver is moving at a speed above a predetermined level.

11. The safety lighting system for a watercraft set forth in claim 10, further including a video monitor that is operatively connected to said programmable electronic controller, wherein said video monitor displays an alert that said navigation lights are not illuminated when said ambient light levels are detected below a predetermined brightness level.

* * * * *